US009108325B2

(12) United States Patent
Sakon et al.

(10) Patent No.: US 9,108,325 B2
(45) Date of Patent: Aug. 18, 2015

(54) ELECTRIC SHAVER

(75) Inventors: Shigetoshi Sakon, Hirakata (JP); Kenji Narita, Osaka (JP); Jyuzaemon Iwasaki, Nagahama (JP); Makoto Fukutani, Hikone (JP); Hiroaki Shimizu, Hikone (JP); Takeshi Shiba, Hikone (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 876 days.

(21) Appl. No.: 13/009,226

(22) Filed: Jan. 19, 2011

(65) Prior Publication Data

US 2011/0179648 A1 Jul. 28, 2011

(30) Foreign Application Priority Data

Jan. 22, 2010 (JP) ..... 2010-012189

(51) Int. Cl.
*B26B 19/02* (2006.01)
*B26B 19/38* (2006.01)

(52) U.S. Cl.
CPC ..... *B26B 19/384* (2013.01)

(58) Field of Classification Search
CPC ..... B23B 19/384
USPC ..... 30/346.51, 346.61, 346.55, 346.56, 30/346.57, 43.91, 43.92, 34.2, 43.6, 43.9
See application file for complete search history.

(56) References Cited

U.S. PATENT DOCUMENTS 2,297,915 A * 10/1942 Rand, Jr. et al. ..... 30/34.2
2,345,263 A * 3/1944 Jepson ..... 30/43.9
3,602,991 A * 9/1971 Heinrich et al. ..... 30/346.51
3,650,849 A * 3/1972 Nidetzky ..... 148/643
3,742,603 A * 7/1973 Yamaoka ..... 30/346.51
4,035,914 A 7/1977 Blume et al.
4,343,089 A * 8/1982 Suzuki et al. ..... 30/346.51
4,493,149 A * 1/1985 Tanahashi et al. ..... 30/43.92

(Continued)

FOREIGN PATENT DOCUMENTS

DE 4031871 12/1991
EP 0743144 11/1996

(Continued)

OTHER PUBLICATIONS

U.S. Appl. No. 13/049,138 to Jyuzaemon Iwasaki et al., which was filed Mar. 16, 2011.

(Continued)

*Primary Examiner* — Kenneth E. Peterson
*Assistant Examiner* — Jennifer Swinney
(74) *Attorney, Agent, or Firm* — Greenblum & Bernstein, P.L.C.

(57) ABSTRACT

An electric shaver includes: a main body; an outer blade provided to an end of the main body and having a blade hole defined by a bar; and an inner blade provided inward of the outer blade and configured to reciprocate in a longitudinal direction of the outer blade to cut hair in the blade hole with the outer blade. The bar has a hair raising portion coming in contact with hair upon movement of the outer blade on a skin surface to raise hair up from the skin surface. A contact pressure on the skin surface to be exerted by the outer blade in a first portion of the outer blade is greater than that in a second portion of the outer blade. Hair raising performance in raising hair up from the skin surface in the first portion is smaller than hair raising performance in the second portion.

9 Claims, 10 Drawing Sheets

(56) References Cited

U.S. PATENT DOCUMENTS

| | | | | |
|---|---|---|---|---|
| 5,185,926 | A * | 2/1993 | Locke | 30/43.92 |
| 5,185,933 | A * | 2/1993 | Messinger | 30/346.51 |
| 5,367,771 | A * | 11/1994 | Mukai | 30/43.92 |
| 5,857,260 | A * | 1/1999 | Yamada et al. | 30/346.51 |
| 5,901,446 | A * | 5/1999 | Szymansky | 30/43.92 |
| 2007/0056166 | A1* | 3/2007 | Shiba et al. | 30/44 |
| 2008/0005906 | A1* | 1/2008 | Franke et al. | 30/43.7 |
| 2008/0134523 | A1* | 6/2008 | Komori et al. | 30/346.51 |
| 2010/0175262 | A1 | 7/2010 | Shigeta et al. | |

FOREIGN PATENT DOCUMENTS

| | | | | |
|---|---|---|---|---|
| EP | 1930137 | | 6/2008 | |
| JP | 52012068 | A * | 1/1977 | B26B 19/00 |
| JP | 54148660 | A * | 11/1979 | B26B 19/04 |
| JP | 3083548 | B2 | 9/2000 | |

OTHER PUBLICATIONS

U.S. Appl. No. 13/049,369 to Noboru Kobayashi et al., which was filed Mar. 16, 2011.

Search report from E.P.O., mail date is Apr. 27, 2011.

* cited by examiner

ELECTRIC SHAVER

CROSS REFERENCE TO RELATED APPLICATION

This application is based upon and claims the benefit of priority from the prior Japanese Patent Application No. 2010-012189, filed on Jan. 22, 2010, the entire contents of which are incorporated herein by reference.

BACKGROUND OF THE INVENTION

1. Field of the Invention

The present invention relates to an electric shaver, and specifically to an electric shaver provided with a hair raising portion having a hair raising function to raise body hair that has a small angle with respect to a skin surface.

2. Description of the Related Art

Various types of electric shavers exist for shaving body hair. The angle at which body hair extends with respect to a skin surface is called a hair rising angle. Body hair having a large hair rising angle (e.g., 45° to 60°) is easy to shave. However, a problem arises in a case of body hair having a small hair rising angle (e.g., 30° or smaller) because it is difficult to shave. For such body hair having a small hair rising angle, an electric shaver provided with hair raising portions to raise body hair is described in Japanese Patent No. 3083548.

SUMMARY OF THE INVENTION

According to Japanese Patent No. 3083548, the hair raising portions having the equivalent hair raising performance are disposed in both of a portion coming into contact with the skin surface with a large contact pressure and a portion coming into contact with the skin surface with a small contact pressure. Thus, there is a possibility that the hair raising portion in the large contact-pressure portion damages the skin surface.

An object of the present invention is to provide an electric shaver capable of efficiently raising body hair while reducing impact on the skin surface.

An aspect of the present invention is an electric shaver comprising: a main body to be gripped by a user; an outer blade provided to an end portion of the main body and having a blade hole defined by a bar; and an inner blade provided inward of the outer blade and configured to reciprocate in a longitudinal direction of the outer blade to cut hair let in the blade hole in cooperation with the outer blade, wherein the bar has a hair raising portion configured to come in contact with hair upon movement of the outer blade on a skin surface to raise hair up from the skin surface, a contact pressure on the skin surface to be exerted by the outer blade in a first portion of the outer blade is greater than a contact pressure in a second portion of the outer blade, and hair raising performance in raising hair up from the skin surface in the first portion is smaller than hair raising performance in the second portion.

According to the above aspect, by setting the hair raising performance lower for the portion exerting a high contact pressure on the skin surface than for the portion exerting a low contact pressure, it is possible to reduce impact (e.g., damage) on the skin surface given by the portion exerting the high contact pressure on the skin surface. On the other hand, impact on the skin surface given by the portion exerting the low contact pressure on the skin surface is naturally small. Accordingly, the improving of the hair raising performance thereof allows such a portion to raise hair efficiently. Also, a simple action such as moving the electric shaver's main body on the skin surface can automatically raise body hair having a small hair rising angle.

BRIEF DESCRIPTION OF THE DRAWINGS

FIGS. 10A and 10B are cross-sectional views in a top portion and a lateral side portion.

DETAILED DESCRIPTION OF THE EMBODIMENT

Figure 1:
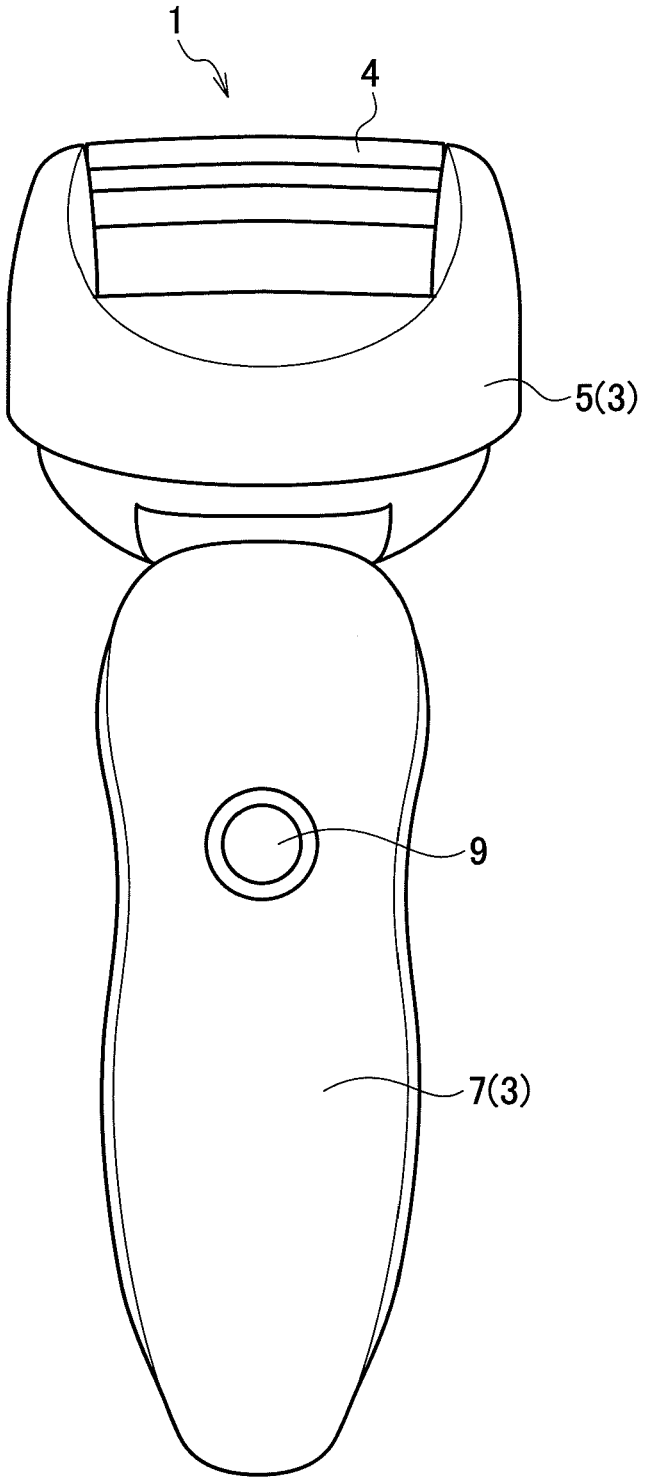
FIG. 1 is a front view showing an electric shaver according to an embodiment of the present invention.

Hereinbelow, an embodiment of the present invention will be described in detail by referring to the drawings.

Figure 2:
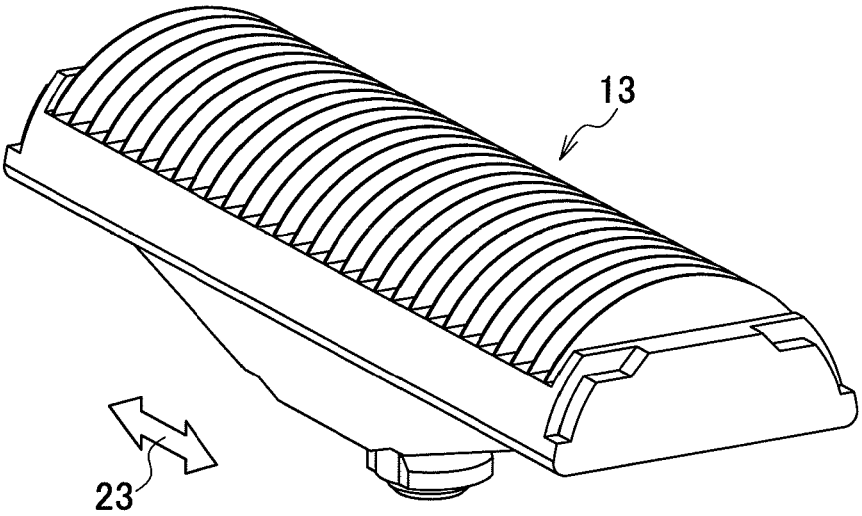
FIG. 2 is a perspective view showing an inner blade.

As shown in FIG. 1, an electric shaver 1 according to the embodiment includes: a lower housing 7 which the user grips; an upper housing 5 connected to the lower housing 7; and a main blade 4 provided at the leading end of the upper housing 5. In the lower housing 7, a push-type switch 9 is disposed. The upper housing 5 and the lower housing 7 together constitute a main body 3 of the electric shaver (hereinafter, referred to as "electric-shaver main body 3"). As shown in FIGS. 1 and 2, the main blade 4 is formed of: an outer blade 11 disposed at an outer side; and inner blades 13 disposed inward of the outer blade 11 and configured to reciprocate in a longitudinal direction 23 (see an arrow in FIG. 3).

Figure 3:
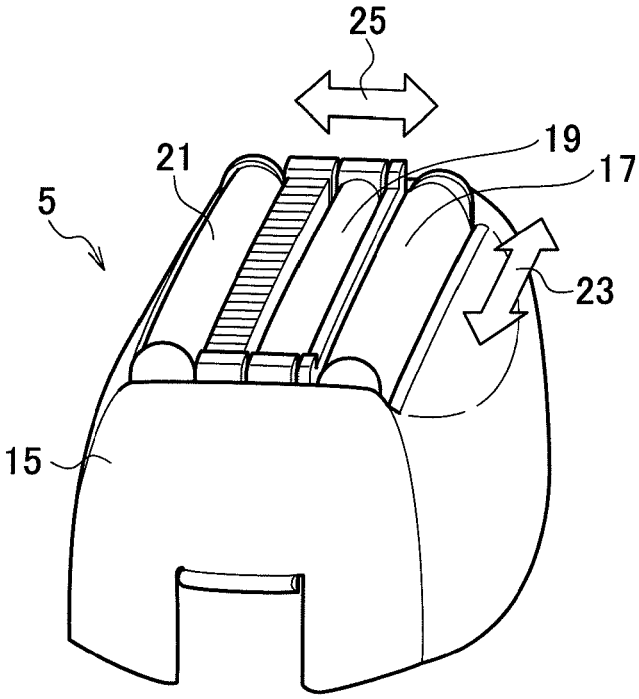
FIG. 3 is a perspective view showing an upper housing.
Figure 4:
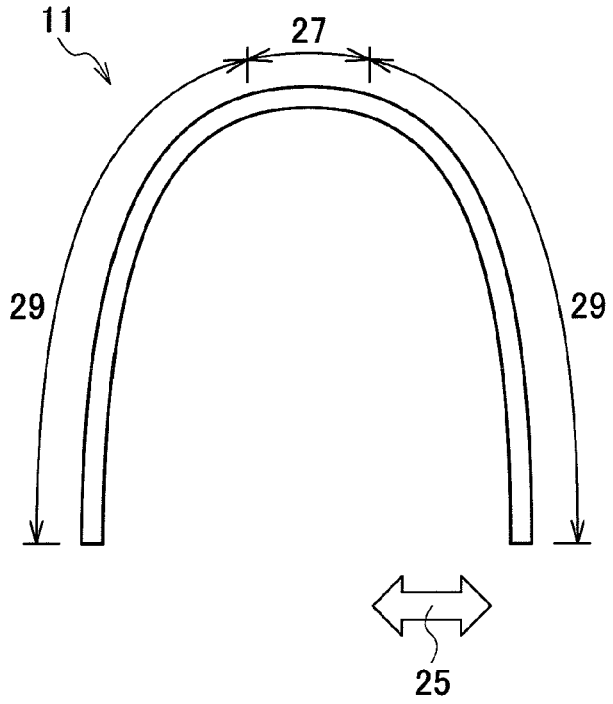
FIG. 4 is a schematic diagram of an outer blade viewed from a lateral side.

As shown in FIG. 3, the upper housing 5 is provided with: a housing main body 15; and first, second and third outer blades 17, 19 and 21 disposed at the upper end of the housing main body 15. The outer blade 11 is formed of the first to third outer blades 17, 19 and 21, and extends in the longitudinal direction 23. The first and third outer blades 17 and 21 are disposed at both lateral sides in a lateral direction 25. The second outer blade 19 is disposed between the first and third outer blades 17 and 21.

The outer blade 11 is formed to curve in a reverse U-shape in the side view. A top portion 27 of the outer blade 11, which is located highest, exerts a large contact pressure on the skin surface. Meanwhile, outer portions 29, which are located at both outer lateral sides of the top portion 27, exert smaller contact pressures on the skin surface than that of the top portion 27.

The outer blade 19 will be described below in detail.

Figure 5:
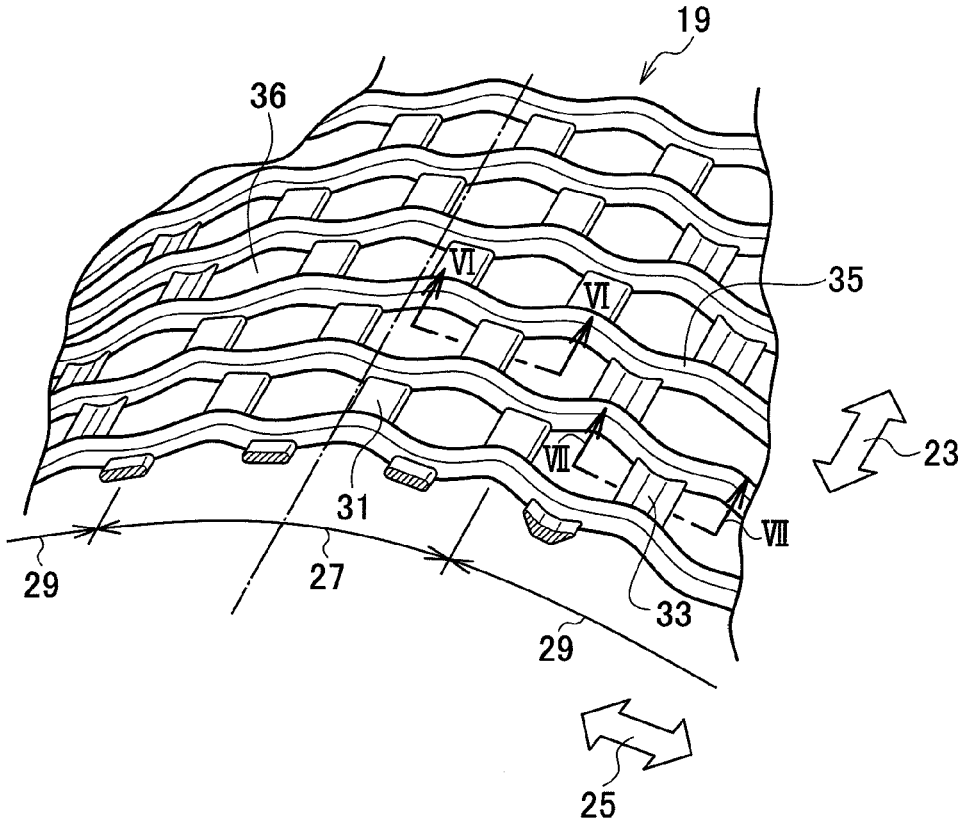
FIG. 5 is an enlarged perspective view of a part of the outer blade.

A dashed line in FIG. 5 is a center line extending along the center, in the lateral direction 25, of the top portion 27. As shown in FIG. 5, lateral bars 35 extend in the lateral direction 25, and longitudinal bars 31 and 33 extend in the longitudinal direction 23. These bars 35, 31 and 33 define blade holes 36 each in a substantially hexagonal shape in the plan view. The blade holes 36 are formed into such sizes that body hair can be let therein. The longitudinal bars 31 each have cross-sectional shapes shown in FIGS. 6A and 6B and are disposed to the top portion 27. The longitudinal bars 33 each have cross-sectional shapes shown in FIGS. 7A and 7B and are disposed to the outer portions 29.

Figure 6A:
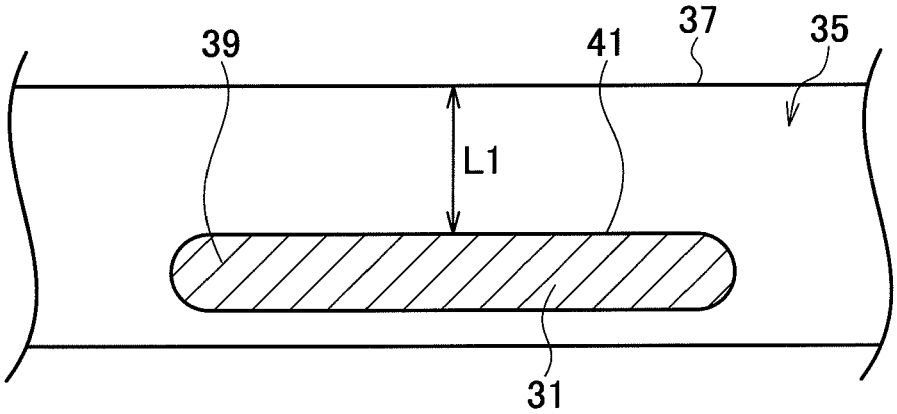
FIG. 6A is a cross-sectional view taken along the VI-VI line of FIG. 5.
Figure 6B:
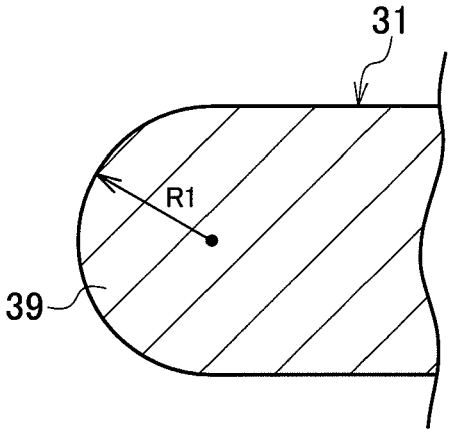
FIG. 6B is an enlarged cross-sectional view of a lateral end.

As shown in FIGS. 6A and 6B, each longitudinal bar 31 is formed into a substantially flat-plate shape in cross section, and each lateral end 39 of the longitudinal bar 31 is formed into a semi-circular shape with a curvature radius of R1 in cross section. The curvature radius R1 may be 10 μm, for example. A top surface 41 of the longitudinal bar 31 is situated closer to the electric-shaver main body than is a top surface 37 of the lateral bar 35. The vertical distance between the top surface 41 of the longitudinal bar 31 and the top surface 37 of the lateral bar 35 is set to L1.

Figure 7A:
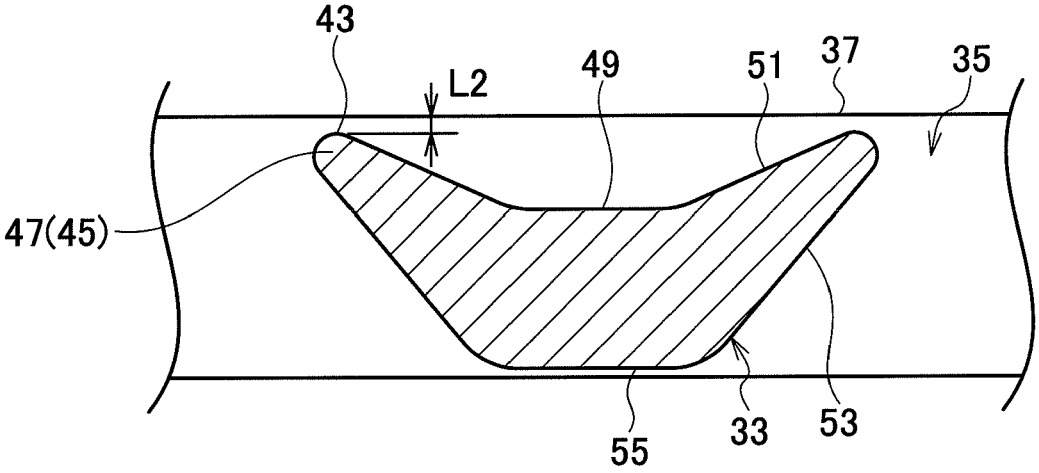
FIG. 7A is a cross-sectional view taken along the VII-VII line of FIG. 5.
Figure 7B:
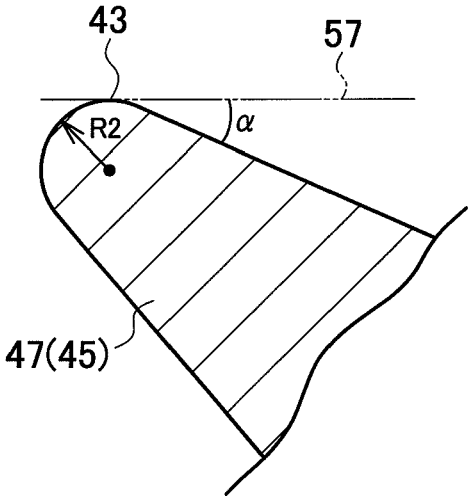
FIG. 7B is an enlarged cross-sectional view of a hair raising portion.

On the other hand, each longitudinal bar 33 is formed into a substantially U-shape in cross section, as shown in FIG. 7A. Specifically, the longitudinal bar 33 has a lateral center portion 49 formed into a flat shape, and bent portions 47 bent upward at and extending laterally from the lateral center portion 49. The lateral end of each bent portion 47 is a hair raising portion 45 having a tapered shape. The hair raising portion 45 has a function to raise body hair having a small angle with respect to the skin surface. A top surface of the bent portion 47 is an inclined top surface 51, and a bottom surface thereof is an inclined bottom surface 53. A surface at the bottom side of the longitudinal bar 33, i.e., a surface at the opposite side from the lateral center portion 49, is a bottom surface 55. In sum, the longitudinal bar 33 is formed by the lateral center portion 49, the inclined top surfaces 51, the inclined bottom surfaces 53 and the bottom surface 55. The vertical distance between each lateral end 43 of the bent portion 47 and the top surface 37 of the lateral bar 35 is set to L2. Thus, the longitudinal bar 33 is so disposed as to be offset from the lateral bar 35 while satisfying a magnitude relation of L2<L1. The difference between L1 and L2 may be 10 μm, for example. As shown in FIG. 7B, the lateral end 43 of the bent portion 47 is formed into a semi-circular shape with a curvature radius of R2 in cross section. The magnitude relation between R1 and R2 is set to be R2<R1. R2 may be 3 μm, for example. A clearance angle α between the inclined top surface 51 and a lateral reference line 57 indicated by a chain double dashed line is set larger than the clearance angle between the top surface 41 of the longitudinal bar 31 shown in FIG. 6A and the lateral reference line 57 (0°). In other words, as to the longitudinal bars 31 and 33 according to the embodiment, no clearance angle (i.e., 0°) is given to the longitudinal bar 31 disposed in the top portion 27, whereas a certain clearance angle is given to the longitudinal bar 33 disposed in the outer portion 29.

Figure 8:
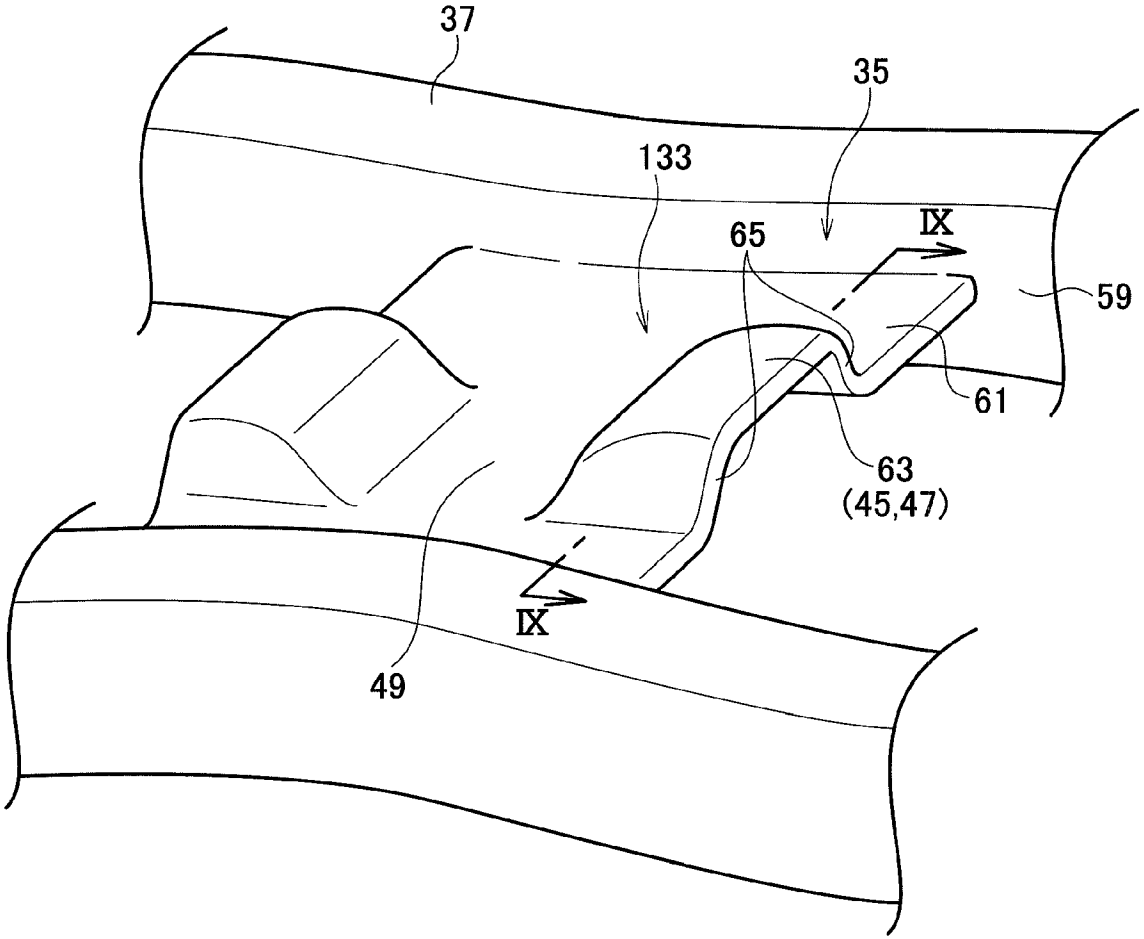
FIG. 8 is an enlarged perspective view of a longitudinal bar and its peripheral portions according to an another embodiment of the present invention.
Figure 9:
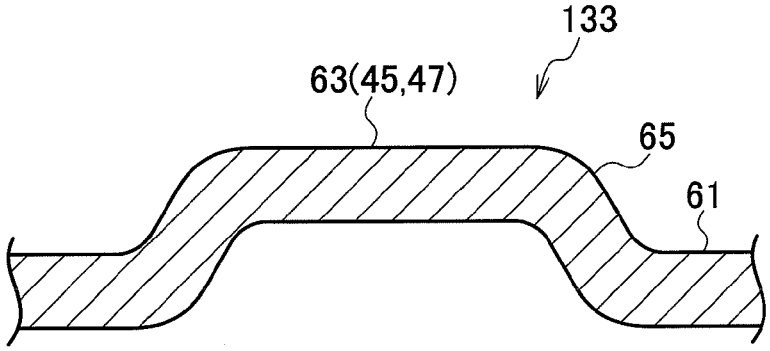
FIG. 9 is an enlarged cross-sectional view take along the IX-IX line of FIG. 8.

FIG. 8 is an enlarged perspective view of a longitudinal bar and its peripheral portion according to an another embodiment of the present invention. FIG. 9 is an enlarged cross-sectional view taken along the IX-IX line of FIG. 8.

As shown in FIGS. 8 and 9, each of longitudinal end portions 61 of the longitudinal bar 133 according to the another embodiment of the present invention extends in the longitudinal direction from the sidewall 59 of the corresponding lateral bar 35 substantially linearly in cross section. The longitudinal end portion 61 is connected to a longitudinal center portion 63 via a gently-curving boundary portion 65. The curvature radius of the boundary portion 65 may be 10 μm, for example. In the longitudinal bar 33 shown in FIG. 5, the hair raising portions 45 (see FIGS. 7A and 7B) are continuously extended across the longitudinal direction 23 of the longitudinal bar 33. In the longitudinal bar 133 shown in FIGS. 8 and 9, the hair raising portions 45 (the bent portions 47) are not extended from the sidewall 59 of the corresponding lateral bar 35 but are formed only at the longitudinal center (in a middle portion) of the longitudinal bar 133.

As modifications, bars in various different shapes can be applied to the longitudinal bars, besides the longitudinal bars 31, 33, and 133 described above. First, longitudinal bars 71 and 79 according to Modification 1 will be described.

Figure 10A:
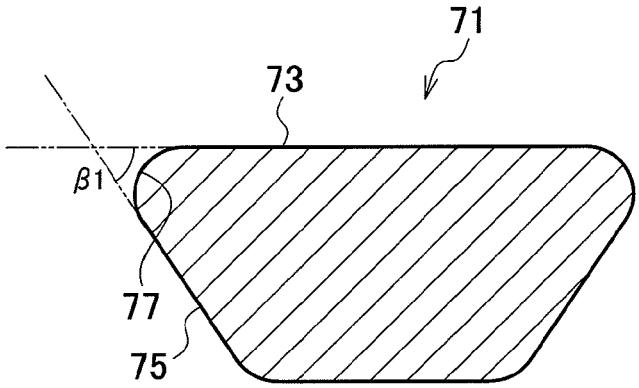
FIGS. 10A and 10B show longitudinal bars according to Modification 1.
Figure 10B:
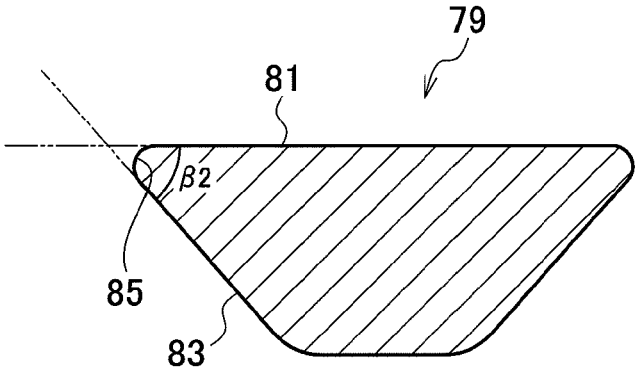

As shown in FIG. 10A, in the longitudinal bar 71 disposed in the top portion 27, a top surface 73 is formed flatly, and hair raising portions 77 are formed at both lateral ends thereof. The opening angle of a tapered portion formed by the top surface 73 and an inclined surface 75 is set to β1. Meanwhile, as shown in FIG. 10B, in the longitudinal bar 79 disposed in the outer portion 29, a top surface 81 is formed flatly, and hair raising portions 85 are formed at both lateral ends thereof. The opening angle of a tapered portion formed by the top surface 81 and an inclined surface 83 is set to β2. Here, the magnitude relation between β1 and β2 is set to be β2<β1, where β1 may be 70° and β2 may be 20°, for example.

Figure 11:
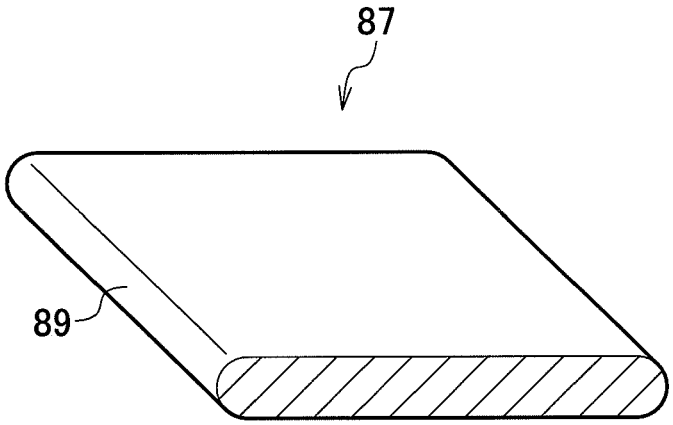
FIG. 11 is a cross-sectional view of a longitudinal bar according to Modification 2.

A longitudinal bar 87 according to Modification 2 shown in FIG. 11 is formed into a flat-plate shape, and both lateral ends thereof are set as semi-circular hair raising portions 89. Even with such a flat-plate shape, the longitudinal bar 87 can be employed as the longitudinal bar in the top portion and in the outer portion as long as the top portion is different from the outer portion in terms of the vertical distance to the top surface 37 of the lateral bar 35, for example.

Figure 12:
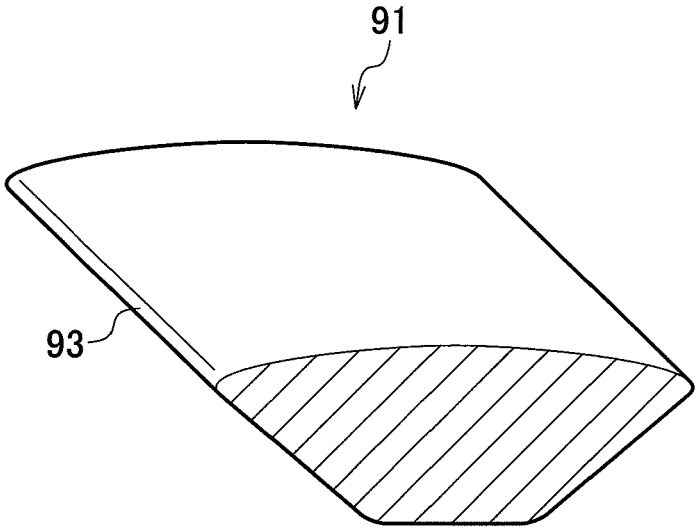
FIG. 12 is a cross-sectional view of a longitudinal bar according to Modification 3.

A longitudinal bar 91 according to Modification 3 shown in FIG. 12 differs from the aforementioned longitudinal bars 71 and 79 according to Modification 1 in FIG. 10 in that its top surface is curving upward. Both lateral ends are set as semi-circular hair raising portions 93.

Figure 13:
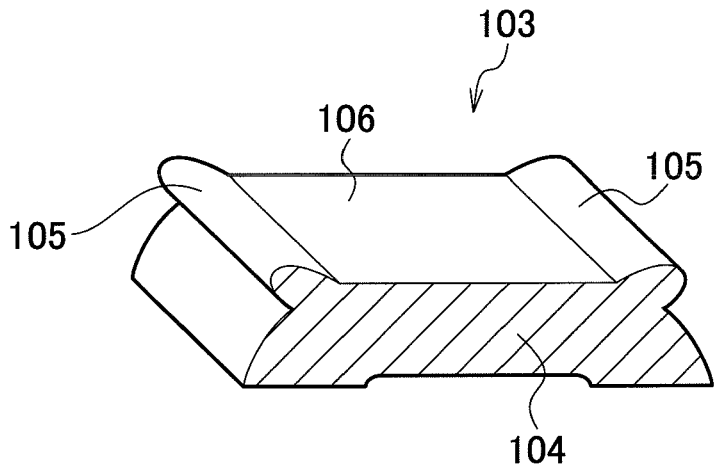
FIG. 13 is a cross-sectional view of a longitudinal bar according to Modification 4.

A longitudinal bar 103 according to Modification 4 shown in FIG. 13 is provided with paired hair raising portions 105 and 105 at both lateral ends of a top surface 106 of a main body portion 104. The top surface 106 is formed as a flat surface.

Figure 14:
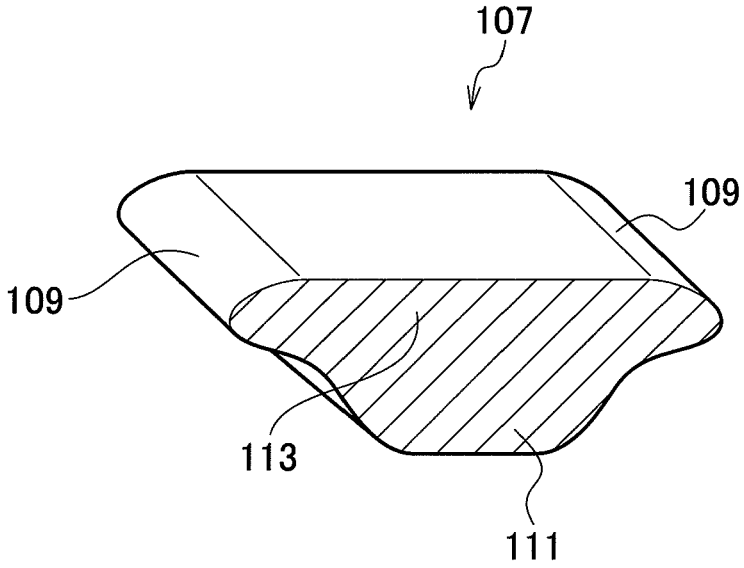
FIG. 14 is a cross-sectional view of a longitudinal bar according to Modification 5.

A longitudinal bar 107 according to Modification 5 shown in FIG. 14 is provided with paired hair raising portions 109 and 109 at both lateral ends of a main body portion 113. A projecting portion 111 extending downward is formed at a bottom end portion of the longitudinal bar 107.

Figure 15:
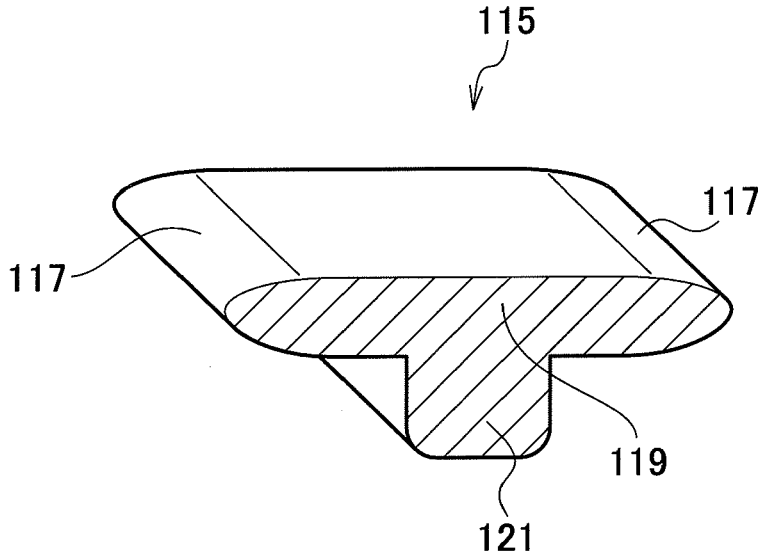
FIG. 15 is a cross-sectional view of a longitudinal bar according to Modification 6.

A longitudinal bar 115 according to Modification 6 shown in FIG. 15 is provided with paired hair raising portions 117 and 117 at both lateral ends of a main body portion 119. A projecting portion 121 extending downward is formed at a bottom end portion of the longitudinal bar 115. In this manner, the longitudinal bar 115 is formed into a substantially T-shape in cross section.

Figure 16:
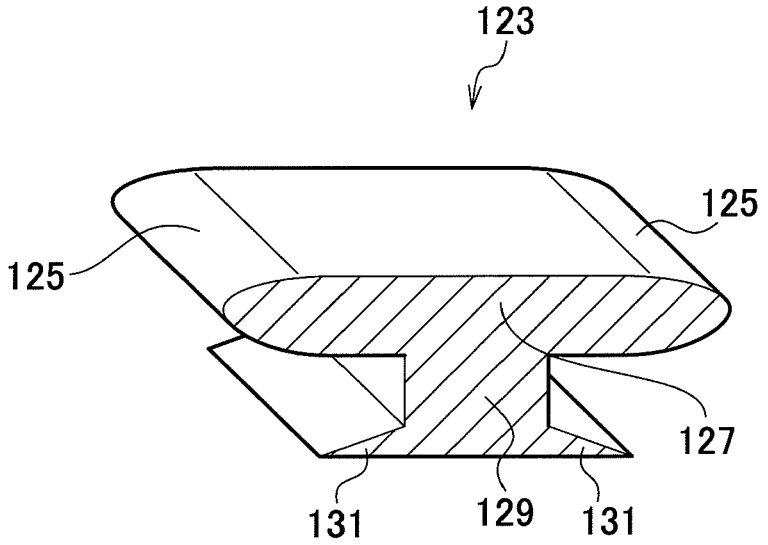
FIG. 16 is a cross-sectional view of a longitudinal bar according to Modification 7.

A longitudinal bar 123 according to Modification 7 shown in FIG. 16 is provided with paired hair raising portions 125 and 125 at both lateral ends of a main body portion 127. A projecting portion 129 extending downward is formed at a bottom end portion of the longitudinal bar 123. Moreover, extending portions 131 and 131 each having a triangular shape and respectively extending laterally are formed at bottom end portions of the projecting portion 129. In this manner, the longitudinal bar 123 is formed into a substantially H-shape in cross section.

Operations and effects of the embodiment will be described below.

(1) The electric shaver 1 according to the embodiment includes: the electric-shaver main body 3 which the user grips; the outer blade 11 provided at an end portion of the electric-shaver main body 3; and the inner blades 13 provided inward of the outer blade 11 and configured to reciprocate in the longitudinal direction of the outer blade 11. The outer blade 11 has the blade holes 36 defined by the bars. Body hair is let in the blade holes 36 and cut between the outer blade 11 and the inner blades 13. The bars of the outer blade 11 are provided with the hair raising portions 45, 77, 85, 89, 93, 105, 109, 117 or 125 that come into contact with body hair when the outer blade 11 is moved on the skin surface and raise the body hair from the skin surface. Among several portions of the outer blade 11, the hair raising performance in raising body hair, is set smaller for a portion where the outer blade 11 exerts a high contact pressure (e.g. , the top portion), than the other portions exerting low contact pressures (e.g., the outer portions).

By setting the hair raising performance lower for the portion exerting a high contact pressure on the skin surface than for the portions exerting low contact pressures as described above, it is possible to reduce impact (e.g., damage) on the skin surface given by the portion exerting the high contact pressure on the skin surface.

Impact on the skin surface given by the portions exerting the low contact pressures on the skin surface is naturally small. Accordingly, the improving of the hair raising performance thereof allows such portions to raise hair efficiently.

(2) The electric shaver 1 according to the embodiment includes the bars formed of: the longitudinal bars 31, 33, 71, 79, 87, 91, 103, 107, 115 or 123 extending in the longitudinal direction of the outer blade 11 and provided with the hair raising portions; and the lateral bars 35 extending in the lateral direction intersecting with the longitudinal direction. This forms the outer blade 11 into a net-like pattern and makes it easier for body hair to be let in the blade holes 19. Accordingly, body hair can be shaved easily.

(3) The outer blade 11 is formed to curve in a reverse U-shape in the side view. The top portion 27 of the outer blade 11 exerts a high contact pressure on the skin surface. Meanwhile, the outer portions 29, which are located at the outer lateral sides of the top portion 27, exert low contact pressures on the skin surface. The hair raising portions are formed at both lateral ends of the longitudinal bars of the outer blade 11.

Such a configuration makes it possible to raise body hair through the moving of the electric-shaver main body 3 toward either side in the lateral direction. Thus, the usability of the electric shaver 1 can be improved for its user.

(4) Both lateral ends of the longitudinal bars 31 and 33 of the outer blade 11 are formed as the tapered hair raising portions 45. The curvature radius R1 of each of the lateral ends of the longitudinal bars 31 in the portion where the outer blade 11 exerts a high contact pressure on the skin surface is set larger than the curvature radius R2 of each of the lateral ends of the longitudinal bars 33 in the other portions where the outer blade 11 exerts low contact pressures.

In such a configuration, each hair raising portion 45 is made by shaping the lateral end to taper in cross section. Thus, the hair raising portion 45 can be formed in a simple shape. In addition, the curvature radius R1 of the lateral end in the portion exerting the high contact pressure on the skin surface is set larger than the curvature radius R2 of the lateral end in the portions exerting the low contact pressures. Accordingly, it is possible to more securely reduce impact (e.g., damage) on the skin surface given by the portion exerting the high contact pressure on the skin surface.

(5) The top surfaces of the longitudinal bars 31 and 33 are situated closer to the electric-shaver main body 3 (i.e., situated farther from the skin surface) than are the top surfaces of the lateral bars 35. Thus, the longitudinal bars 31 and 33 are so disposed as to be offset from the lateral bars 35. In addition, the distance L1 between the top surface of each lateral end 39 of the longitudinal bar 31 and the top surface 37 of the lateral bar 35 in the portion where the outer blade 11 exerts a high contact pressure on the skin surface is set larger than the distance L2 between the top surface of each lateral end 43 of the longitudinal bar 33 and the top surface 37 of the lateral bar 35 in the portion where the outer blade 11 exerts a low contact pressure on the skin surface.

Such a configuration makes it possible to reduce impact (e.g., damage) on the skin surface given by the longitudinal bar 31 in the portion where the outer blade 11 exerts the high contact pressure on the skin surface.

(6) The opening angle β1 of the tapered portion at each lateral end of the longitudinal bar 71 in the portion where the outer blade 11 exerts a high contact pressure on the skin surface is set larger than the opening angle β2 of the tapered portion at each lateral end of the longitudinal bar 79 in the portions exerting low contact pressures on the skin surface. Accordingly, it is possible to reduce impact (e.g., damage) on the skin surface given by the portion exerting the high contact pressure on the skin surface.

(7) As the hair raising portions 45, the bent portions 47 are provided which are the lateral ends, of each longitudinal bar 33, situated farther from the electric-shaver main body 3 than is the lateral center portion 49 of the longitudinal bar 33. Thus, the longitudinal bar 33 as a whole is formed into a substantially U-shape in cross section. In addition, the clearance angle α is formed between the top surface of each bent portion 47 and the lateral reference line 57. Further, the clearance angle in the portion where the outer blade 11 exerts a high contact pressure on the skin surface (0°) is set smaller than the clearance angle α in the portions where the outer blade 11 exerts low contact pressures on the skin surface.

Such a configuration makes it possible to reduce impact (e.g., damage) on the skin surface given by the portion exerting the high contact pressure on the skin surface. The clearance angle in the portions exerting the low contact pressures may be 20° while the clearance angle in the portion exerting the high contact pressure may be 5°, for example.

(8) Each of the longitudinal end portions 61 of the longitudinal bar 33 is formed into a substantially linear shape in cross section. In addition, the bent portion 47 is provided to the longitudinal center portion 63. Moreover, the longitudinal end portions 61 are connected to the longitudinal center portion 63 via the gently-curving boundary portions 65.

By connecting the longitudinal end portions 61 to the longitudinal center portion 63 via the gently-curving boundary portions 65 in the longitudinal bar 33 in this manner, it is possible to reduce impact (e.g., damage) on the skin surface given by the boundary portions 65 when the outer blade 11 is moved on and along the skin surface.

(9) No clearance angle is given to the lateral ends 39 of the longitudinal bar 31 in the portion where the outer blade 11 exerts a high contact pressure on the skin surface. Meanwhile, the clearance angle a is given to lateral ends 43 of the longitudinal bar 33 in the portions exerting low contact pressures. Accordingly, it is possible to more securely reduce impact (e.g., damage) on the skin surface given by the longitudinal bar 31 in the portion exerting the high contact pressure on the skin surface.

The present invention is not limited to the above embodiment, and various modifications can be made on the basis of the gist of the present invention.

For example, the leading end portions of the longitudinal bars 31 and 33 are formed into arc shapes with predetermined curvature radii so as to serve as edges causing no irritation of the skin surface; however, the leading end portions may be in polygonal shapes. Moreover, each of the polygonal shapes may be designed to have obtuse angles.

Further, in the above embodiment, a level difference is provided between the top surface of the lateral bar 35 and the top surface of the longitudinal bar 31; however, the present invention is not limited to such a configuration, and the top surfaces of the lateral and longitudinal bars 35 and 31 may be at the same height.

What is claimed is:

1. An electric shaver comprising:

a main body to be gripped by a user;

an outer blade provided to an end portion of the main body, the outer blade comprising longitudinal bars extending in a longitudinal direction of the outer blade and lateral bars extending in a lateral direction intersecting with the longitudinal direction, wherein the longitudinal bars and the lateral bars intersect to define blade holes; and an inner blade provided inward of the outer blade and configured to reciprocate in a longitudinal direction of the outer blade to cut hair let in the blade holes in cooperation with the outer blade, wherein the longitudinal bars are located in first and second portions of the outer blade and have hair raising portions configured to come in contact with hair upon movement of the outer blade on a skin surface to raise hair up from the skin surface, the outer blade has a curved shape in a side view, the first portion is a top portion of the curved shape, the second portion is an outer portion situated at either outer side, in the lateral direction, of the top portion of the curved shape, a contact pressure on the skin surface to be exerted by the outer blade in the first portion is greater than a contact pressure in the second portion, a cross-section of the longitudinal bars in the first portion have a different shape than a cross-section of at least one of the longitudinal bars in the second portion, hair raising performance in raising hair up from the skin surface by the longitudinal bars in the first portion is smaller than hair raising performance by the longitudinal bars in the second portion, the hair raising portions are formed into a tapered shape at an end, in the lateral direction, of the longitudinal bars, and a curvature radius of the end, in the lateral direction, of the longitudinal bars in the first portion is larger than a curvature radius of the end, in the lateral direction, of the longitudinal bars in the second portion.

2. The electric shaver according to claim 1, wherein the curved shape is a reverse U-shape in the side view, and the hair raising portions include first and second hair raising portions formed at both ends, in the lateral direction, of the longitudinal bars.

3. The electric shaver according to claim 1, wherein each of the longitudinal bars have a top surface offset from a corresponding top surface of the lateral bars toward the main body, a distance between the corresponding top surface of the lateral bars and a corresponding top surface of an end, in the lateral direction, of the longitudinal bars in the first portion is larger than a distance between the corresponding top surface of the lateral bars and a corresponding top surface of an end, in the lateral direction, of the longitudinal bars in the second portion.

4. The electric shaver according to claim 1, wherein the hair raising portions have a bent portion formed by causing an end, in the lateral direction, of the longitudinal bars in the second portion to be spaced away from the main body farther than is a center portion, in the lateral direction, of the longitudinal bars in the second portion, the longitudinal bars in the second portion as a whole has a U-shape cross section, a top surface of the bent portion forms a clearance angle with respect to the lateral direction, and a first clearance angle in the first portion is smaller than a second clearance angle in the second portion.

5. The electric shaver according to claim 4, wherein the longitudinal bars in the second portion have:

a longitudinal end portion having a linear shape in cross section;

a longitudinal center portion where the bent portion is formed; and a boundary portion gently curved to connect the longitudinal end portion to the longitudinal center portion.

6. The electric shaver according to claim 4, wherein the first clearance angle is 0°.

7. The electric shaver according to claim 1, wherein an opening angle of the tapered end, in the lateral direction, of the longitudinal bars in the first portion is larger than an opening angle of the tapered end, in the lateral direction, of the longitudinal bars in the second portion.

8. The electric shaver according to claim 1, wherein the longitudinal bars are provided in adjacent rows that extend in the lateral direction, and wherein the longitudinal bars in one of the adjacent rows are offset in a lateral direction from the longitudinal bars in another of the adjacent rows.

9. The electric shaver according to claim 1, wherein the lateral bars have undulations extending in the lateral direction.

* * * * *